United States Patent [19]

Sabis

[11] 4,317,099

[45] Feb. 23, 1982

[54] FUSE LINK

[75] Inventor: Richard J. Sabis, Chicago, Ill.

[73] Assignee: S&C Electric Company, Chicago, Ill.

[21] Appl. No.: 132,923

[22] Filed: Mar. 24, 1980

[51] Int. Cl.[3] ..... H01H 85/02

[52] U.S. Cl. ..... 337/170; 337/231

[58] Field of Search ..... 337/168–181, 337/190, 281, 282, 291, 231, 232; 339/276 S

[56] References Cited

U.S. PATENT DOCUMENTS

| | | | |
|---|---|---|---|
| 2,108,993 | 2/1938 | Ramsey | 337/168 |
| 2,283,701 | 5/1942 | Smith | 337/291 |
| 2,394,590 | 2/1946 | Boothe | 337/291 |

*Primary Examiner*—William H. Beha, Jr.
*Attorney, Agent, or Firm*—John D. Kaufmann

[57] ABSTRACT

An improved fuse link has a fusible element attached between first and second terminals. The first terminal is attached to, or integral with, a length of flexible stranded cable. The terminals, the fusible element and some of the cable are within an arc-extinguishing sheath. The cable is unified and stiffened for a selected distance immediately adjacent the first terminal to act thereat substantially as a solid rod. The unified region acts as a guide for the first terminal moving through the sheath, reduces binding friction between the cable and the sheath, and eliminates "mushrooming" of the cable within the sheath.

13 Claims, 11 Drawing Figures

78
102
86'
96'
98
100
104
106
94
92

FUSE LINK

BACKGROUND OF THE INVENTION

1. Field of the Invention

The present invention relates to an improved fuse link and, more particularly, to an improved fuse link which is less expensive to manufacture from both a material and a labor standpoint than prior art fuse links and which exhibits improved operating performance notwithstanding the decrease in expense thereof. The improved fuse link of the present invention may be used with a cutout of the type described and claimed in commonly assigned, co-filed U.S. patent application, Ser. No. 132,924 filed Mar. 24, 1980 in the name of Bruce A. Biller. The cutout of the last named patent application may include an improved fuse tube with which the improved fuse link of the present invention may be used, the fuse tube being described and claimed in commonly assigned, co-filed U.S. patent application, Ser. No. 132,922 filed Mar. 24, 1980 in the name of William E. Schmunk.

2. Discussion of the Prior Art

Fuse cutouts and fuse links therefor are well known. A typical fuse cutout includes a hollow insulative fuse tube having conductive ferrules mounted to the opposite ends thereof. One ferrule (often called the "exhaust" ferrule) is located at an exhaust end of the fuse tube and usually includes a trunnion casting which interfits with a trunnion pocket of a first contact assembly carried by one end of a procelain or similar insulator. The other ferrule is normally held by a second contact assembly carried by the other end of the porcelain insulator so that the fuse tube is normally parallel to, but spaced from, the porcelain insulator. The porcelain insulator is mountable to the cross-arm of a utility pole or a similar structure. The fuse link, described in greater detail below, is located within the fuse tube with its ends respectively electrically continuous with the ferrule. One point of an electrical circuit is connected to the first contact assembly, while another point of the circuit is connected to the second contact assembly. Often, the insulator and the fuse tube are generally oriented perpendicular to the ground so that the one ferrule and the first contact assembly are located below the other ferrule and the second contact assembly.

The fuse tube may include a high burst strength outer portion—for example, a fiber-glass-epoxy composite—lined with or containing an ablative arc-extinguishing material, such as horn fiber or bone fiber.

Normal currents flowing through the electrical circuit flow without affecting the fuse link. Should a fault current or other over-current, to which the fuse link is designed to respond, occur in the circuit, the fuse link operates as described below. Operation of the fuse link permits the other or upper ferrule to disengage itself from the second or upper contact assembly whereupon the fuse tube rotates downwardly due to the coaction of the trunnion casting and the trunnion pocket. If the fuse link operates properly, current in the circuit is interrupted and the rotation of the fuse tube gives a visual indication that the cutout has operated to protect the circuit Typical fuse links include a first terminal and a second terminal, between which there is normally connected a fusible element made of pure silver, silver-tin, or the like. Also connected between the terminals may be a strain wire for a purpose described below. The second terminal is electrically continuous with, and is usually mechanically connected to, a button assembly, which is engageable by a portion of the upper ferrule on the fuse tube. The first terminal is connected to a flexible, stranded length of cable. Surrounding at least a portion of the second terminal, the fusible element, the strain wire (if used), the first terminal, and some portion of the flexible stranded cable is a sheath. The sheath is typically made of a so-called ablative arc-extinguishing material (such as horn fiber) or is a cellulosic material impregnated with an ablative arc-extinguishing material. Such ablative arc-extinguishing materials are well known and typically comprise compounds or compositions which, when exposed to the heat of a high-voltage arc, ablate to rapidly evolve large quantities of de-ionizing, turbulent and cooling gases. Typically, the sheath is much shorter than the fuse tube and terminates short of the exhaust end of the fuse tube.

The free end of the stranded cable exits the fuse tube from the exhaust end thereof and has tension or pulling force maintained thereon by a spring-loaded flipper on the lower ferrule. The tension or pulling force exerted on the cable by the flipper attempts to pull the cable and the first terminal out of the sheath and out of the fuse tube. The force of the flipper is normally restrained by the strain wire, typical fusible elements not having sufficient mechanical strength to resist this tension or pulling force.

In the operation of typical cutouts containing prior art fuse links, the fault current or other over-current referred to above results first in the melting or vaporization of the fusible element, followed by the melting or vaporization of the strain wire. Following such melting or vaporization, a high-voltage arc is established between the first and second terminals within the sheath and the flipper is now free to pull the cable and the first terminal out of the sheath and ultimately out of the fuse tube. As the arc forms, the arc-extinguishing materials of the sheath begins to ablate and high quantities of deionizing, turbulent and cooling gases are evolved. The movement of the first terminal under the action of the flipper, and the subsequent rapid movement thereof due to the evolved gases acting thereon as on a piston, results in elongation of the arc. The presence of the de-ionizing, turbulent and cooling gas, plus arc elongation, may, depending on the level of the fault current or other over-current, ultimately result in extinction of the arc and interruption of the current at a subsequent current zero. The loss of the tension on the stranded cable originally effected by the flipper permits the trunnion to experience some initial movement relative to the lower contact assembly which permits the upper ferrule to disengage itself from the upper contact assembly. This initiates the downward rotation of the fuse tube and its upper ferrule to a so-called "drop out" or "drop down" position.

As noted immediately above, arc elongation within the sheath and the action of the evolved gases may extinguish the arc. At very high fault current or over-current levels, however, arc elongation and the sheath may not, by themselves, be sufficient to achieve this end. Simply stated, at very high fault current levels, either the sheath may burst (because of the very high pressure of evolved gas) or insufficient gas may be evolved therefrom to quench the high current level arc. For these reasons, the fuse tube is made of, or is lined with, the ablative arc-extinguishing horn fiber or bone fiber, as noted above. In the event the sheath bursts, the arc-extending material of the fuse tube interacts with the arc; gas evolved as a result thereof effects arc extinction. If the sheath does not burst, the arc-extinguishing material of the fuse tube between the end of the sheath and the exhaust end of the fuse tube is available for evolving gas in addition to that evolved from the sheath. The joint action of the two quantities of evolved gas, together with arc elongation, extinguish the arc.

Many manufacturers of cutouts and fuse links of the types described above continue to make concerted efforts to decrease the costs of both the material and labor thereof, both as a matter of simple, good commercial practice, and in view of the fact that certain materials, such as silver, copper and bronze, continue to experience large price increases. At the same time, manufacturers of cutouts and fuse links continue ongoing programs to improve the performance of these products. Evidence of one such attempt at improving fuse links is commonly assigned U.S. Pat. No. 4,272,572 issued June 9, 1981 to Bruce A. Biller and Hiram Jackson.

This last-named patent has as a goal the modification of the first terminal of the fuse link. Specifically, in typical prior art fuse links, the first terminal is an elongated metallic sleeve which is crimped around the flexible stranded cable and the ends of the fusible element and the strain wire. Elimination of the sleeve, it was surmised, would decrease the cost of the fuse link by eliminating material therefrom. However, some good and sure method of attaching the fuse link and the strain wire to the flexible cable had to be found. A solution to that problem is the subject matter of that patent. Briefly, it was found that compressing (by swaging of the like) a small length of the flexible, stranded cable into a somewhat semi-solid mass having a pocket formed therein, followed by placement of the ends of the fusible elements and the strain wire into the pocket, further followed by closure of the pocket by further compressing the cable, resulted in good mechanical and electrical connection between the flexible stranded cable and both the fusible element and the strain wire. Here, the compressed portion of the cable acts as, or in place of, the first terminal.

As an alternative to the invention of the last-named patent, a mere decrease in the length of the sleeve forming the lower terminal has been attempted. This clearly effects a material savings in fuse links. However, it was found that when the first terminal of the fuse link was either eliminated or shortened, certain problems in the operation of the fuse links could result. A first problem was that, due to the flexibility of the stranded cable, the shorter first terminal could become cocked within the sheath from which the terminal is very closely spaced. Cocking of the terminal, it was found, could result in wedging the edges of the terminal against the side walls of the sheath, thus inhibiting or preventing full movement of the first terminal and the cable out of the sheath and the fuse tube. From the above description of the fuse link and the fuse tube, it can be seen that if the first terminal and cable cannot fully and freely move out of the sheath and the fuse tube, arc interruption may not occur since insufficient arc elongation may result. A second problem involves the fact that forces on the first terminal, due to the gases evolved when the arc interacts with the arc-extinguishing material, push piston-like upon the first terminal. At times, this pushing force can cause the cable immediately adjacent the shorter first terminal to "baloon" or "mushroom" out. Such "ballooning" or "mushrooming" is manifested by a separation among, and a spreading out of, the individual strands of the flexible stranded cable. The ballooned or mushroomed portion of the cable could frictionally engage the side walls of the sheath, again inhibiting or preventing full movement of the first terminal and the cable out of the sheath and, ultimately, out of the fuse tube. This phenomenon had a deleterious effect upon the operation of the fuse link and the cutout.

The present invention is intended to solve both of the above described two problems, while achieving the overall goals of improving fuse link and cutout performance, and at the same time decreasing costs.

SUMMARY OF THE INVENTION

According to the present invention, there is provided an improved fuse link usable with fuse cutouts or similar devices. The fuse link is of the type which includes a fusible element attached between a first and a second terminal. The first terminal is in turn attached to a length of stranded, flexible cable. The first terminal, the fusible element, at least a portion of the second terminal, and a portion of the cable are normally surrounded by an arc-extinguishing sheath held at one end to the second terminal. The improved fuse link may also have the fusible element attached directly to one end of the cable. In this event, the point of attachment of the fusible element to the cable serves as the first terminal.

The improved fuse link comprises a unified and thereby stiffened region of the cable. The unified and stiffened region is formed in the cable immediately adjacent the first terminal and extends away from the first terminal a selected distance. The region normally acts substantially as a solid rod, while the remainder of the cable remains flexible.

The unified and stiffened region of the cable may be produced by compacting the cable without the use of heat or the addition of material, or by the addition thereto of material, such as an adhesive, polymer, or the like. In preferred embodiments, the unified and stiffened region is swaged until it has a cross sectional area less than that of the remainder of the cable. A preferred cross sectional area of the unified and stiffened region is about 95% of the sum of the cross sectional areas of the individual strands making up the cable. Also preferably, the extent of the unified and stiffened region is approximately one inch away from the first terminal. Moreover, the region smoothly tapers and merges with the remainder of the cable so that none of the strands are cut by the swaging process.

In the improved fuse link described above, the first terminal and the unified and stiffened region exit both the sheath and a fuse tube of a fuse cutout which surrounds the sheath. The stiffness of the region permits it to act as guide for the first terminal as it moves through the sheath by reducing binding friction between both the first terminal and cable and the sheath in the vicinity of the first terminal. The unified and stiffened region also eliminates bulging or mushrooming of the cable as it moves within the sheath. Furthermore, although the region remains stiff within the sheath and the fuse tube, upon exiting the sheath and the fuse tube, the region has the capability of flexing transversely and thereafter acting as a flexible, non-solid member.

DETAILED DESCRIPTION

Figure 1:
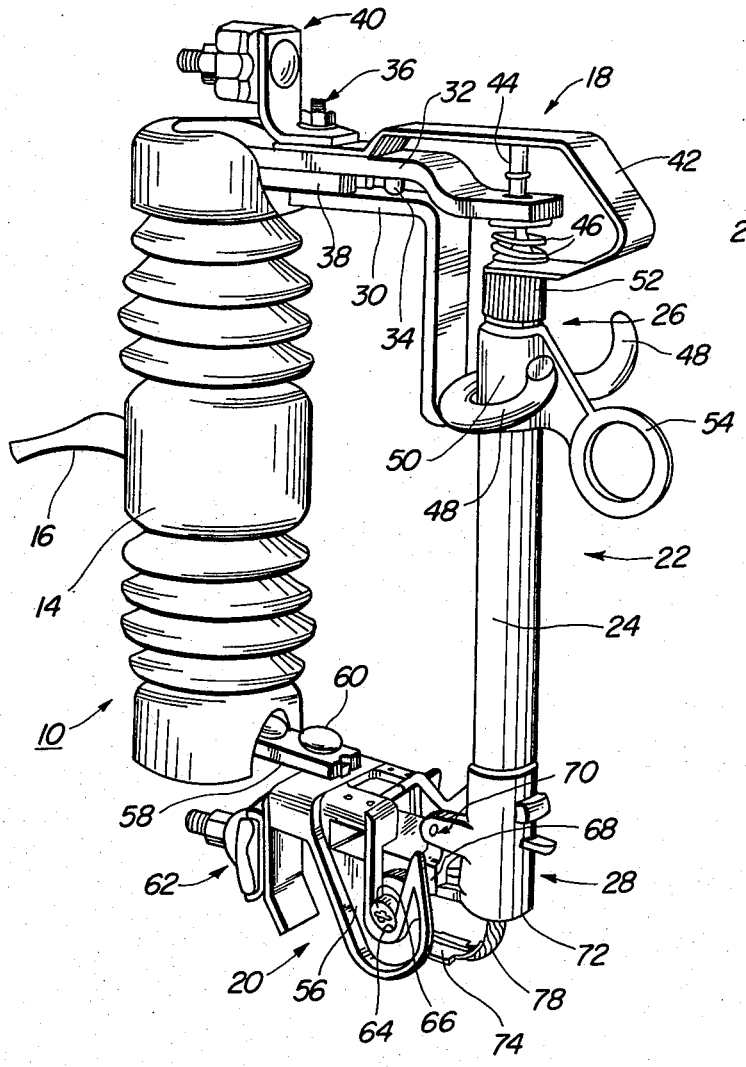
FIG. 1 is a perspective, elevational view of a fuse cutout which contains and utilizes an improved fuse link according to the principles of the present invention.

Referring first to FIG. 1, there is shown a fuse cutout 10 which may contain and use an improved fuse link 12 (FIGS. 4–4*b*) of the present invention. The cutout 10 is first described, followed by a description of prior art fuse links (depicted in FIGS. 2 and 3–3*d*), it being understood that the improved fuse link 12 of the present invention operates in a similar, but improved, manner to that of prior art fuse links, and is also less costly.

The cutout 10 includes an elongated skirted insulator 14 which has affixed thereto a mounting member 16. The mounting member permits mounting of the insulator 14 and the fuse cutout 10 to an upright or a crossarm of a utility pole (not shown). The insulator 14 may be made of porcelain or similar material.

Affixed to the upper end of the insulator 14 is an upper contact assembly generally designated 18. Affixed to the lower end of the insulator 14 is a lower contact assembly 20. The cutout 10 also includes a fuse tube assembly 22 which in the normal or unoperated condition of the cutout 10 may be maintained in the vertical position shown in FIG. 1, although other orientations may be desirable. Specifically, the fuse tube assembly 22 includes an insulative fuse tube 24 of a well-known type, which may comprise an epoxy-fiberglass composite outer shell 24*a* lined with horn fiber or bone fiber 24*b* (see FIGS. 2 and 4B). Mounted or affixed to the upper end of the fuse tube 24 is an upper ferrule assembly 26, while at the opposite lower or exhaust end of the fuse tube 24 is a lower or exhaust ferrule assembly 28. In the position of the fuse tube assembly 22 depicted in FIG. 1, the lower ferrule assembly 28 is held by the lower contact assembly 20 while the upper ferrule assembly 26 is held, and latched against the movement, by the upper contact assembly 18.

The upper contact assembly 18 includes a support bar 30 bend at the 90° angle shown and a recoil bar 32 which runs generally parallel to a portion of the support bar 30. The bars 30 and 32 are connected together and spaced apart by a rivet or stud 34. Near the rivet or stud 34, the two bars 30 and 32 are mounted by a nut and bolt combination 36 to a mount 48, which is attached to the top of the insulator 14. Also held by the nut and bolt 36 is a connector 40, such as a parallel groove connector. The connector 40 facilitates the connection to the upper contact assembly 18 of one cable or conductor of a high voltage circuit.

The upper contact assembly 18 also includes a generally J-shaped spring contact 42. The long leg of the spring contact 42 is attached, as shown, to the upper surface of the recoil bar 32 in the vicinity of the nut and bolt 36. The J curves out, down and back into a short leg, as shown, so that the recoil bar 32 is positioned between the legs of the contact 42. Formed in the short leg of the spring contact 42 is an indentation or concavity which cannot be clearly seen in the FIG. 1. A stud or rod 44 freely passes through a hole (not numbered) formed near the end of the recoil bar 32 and is firmly attached between the legs of the spring contact 42. Preferably, the attachment of the stud or rod 44 to the short leg of the spring contact 42 is opposite to and coaxial with the indentation or concavity formed in the short leg. Thus, although the spring contact 42 may flex near the nut and bolt 36, the legs (interconnected by the stud or rod 44) are constrained to move together.

Acting between the lower surface of the recoil bar 32 and the base of a convexity (not clearly seen in FIG. 1), formed in the short leg of the spring contact 42 complementarily with the indentation or concavity, is a backup spring 46 which sets a rest position for the legs of the spring contact 42.

The downwardly bent portion of the support bar 30 may have mounted thereto attachment hooks 48.

The upper ferrule assembly 26 includes a cast ferrule 50, which is attached or mounted to the upper end of the fuse tube 24. The ferrule 50 may include a threaded portion, (not shown in FIG. 1) on to which may be threaded a contact cap 52. The contact cap 52 is configured so as to fit into and be held by the indentation or concavity formed in the short leg of the spring contact 42 when the fuse tube assembly 22 is in the position shown in FIG. 1. The ferrule 50 may also include a pull ring 54. The pull ring 54 may be engaged by a hot stick or switch stick to move the upper ferrule assembly 26 away from the upper contact assembly 18 while the lower ferrule assembly 28 rotates in the lower contact assembly 20, as described below. In view of the nature of high-voltage circuits, this opening movement of the fuse tube assembly 22 must be effected while the circuit connected to the cutout 10 is de-energized or else an arc will form between the upper ferrule assembly 26 and the upper contact assembly 18. The fuse tube assembly 22 may also be opened by initially attaching between the attachment hooks 48 and the pull ring 54 a portable load-break tool. Such a portable load-break tool permits the fuse tube assembly 22 to be opened with the circuit energized by momentarily having transferred thereto the flow of current in the circuit 10 and interrupting such current internally thereof.

The lower contact assembly 20 includes a support member 56 attached to a mount 58 by a nut and bolt combination 60. The support member 56 may also carry a connector 62, such as a parallel groove connector. The connector 62 facilitates the connection of the lower contact assembly 20 of another cable or conductor of the high-voltage circuit in which the fuse cutout 10 is to be used. It should be noted that the connectors 40 and 62 may both take the form of that described and claimed in commonly assigned U.S. patent application, Ser. No. 218,867 filed Dec. 22, 1980 which is a continuation of application Ser. No. 60,947 filed July 26, 1979 in the name of Hiram Jackson. Moreover, the contact assemblies may take the form of those described and claimed in commonly assigned, so-filed U.S. patent application, Ser. No. 132,924 filed Mar. 24, 1980 in the name of Bruce A. Biller.

Formed in the support member 56 is a trunnion pocket 64. The trunnion pocket 64 is designed to hold outwardly extending portions 66 of a trunnion casting 68 which is pivotally mounted at a toggle joint 70 to a cast ferrule 72 which is attached or mounted to the lower or exhaust end of the fuse tube 24. As hereinafter described, the trunnion casting 68 and the cast ferrule 72 are normally rigidly held in the relative position depicted in FIGS. 1 and 1*a*. In this normal relative position of the trunnion casting 68 and the ferrule 72, the contact cap 52 may be engaged by and held in the concavity formed in the short leg of the spring contact 42 to maintain the fuse tube assembly 22 in the position depicted in FIG. 1. Also, as described in more detail below, when a fuse link within the fuse tube 24 operates, the trunnion casting 68 and the ferrule 72 are no longer so rigidly held, and the ferrule 72 may rotate downwardly relative to the trunnion casting 68 about the toggle joint 70. This movement of the ferrule 72 permits the contact cap 52 to disengage the spring contact 42, following which the entire fuse tube assembly 22 rotates about the lower contact assembly 20 via rotation of the extending portions 66 in the trunnion pockets 64.

Figure 1A:
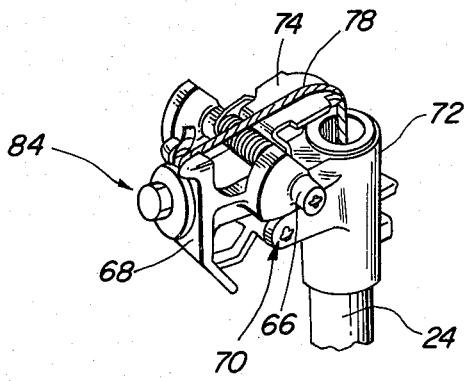
FIG. 1*a* is a view of the underside of the fuse cutout depicted in FIG. 1 showing certain details thereof.

As best seen in FIG. 1*a*, rotatably mounted to the trunnion casting 68 is a flipper 74. A spring 76 mounted between the trunnion casting 68 and the flipper 74 biases the flipper 74 away from the lower or exhaust end of the fuse tube 24.

To use the fuse cutout 10, the fuse tube assembly 22 is first "armed" with a fuse link. Suffice it here to say that the contact cap 52 is removed and the fuse link is inserted into the interior of the fuse tube 24 from the upper end thereof. A portion of the fuse link abuts a shoulder (not shown) at the top of the ferrule 50, following which the contact cap 52 is threaded back onto the ferrule 50. A flexible stranded cable 78 forming a part of the fuse link exits an exhaust opening 80 in the lower or exhaust end of the fuse tube 24. The flipper 74 is manually rotated against the action of the spring 76 to position it adjacent the exhaust opening 80, following which the cable 78 is laid into a channel 82 formed in the flipper 74. Following this, the cable 78 is wrapped around a flanged bolt 84 which is threaded into the trunnion casting 68. Following tightening of the flanged bolt 84 to hold the cable 78, the flipper 74 is maintained against the bias of the spring 76 in the position shown in FIG. 1*a*, whereat there is a constant tension force applied to the cable 78 and, accordingly, to the fuse link within the fuse link tube 24. It is this connection of the cable 78 to the trunnion casting 68 by the flanged bolt 84, and the action of the spring 76 on the flipper 74 which normally holds the trunnion casing 68 and the ferrule 72 in the position depicted in FIGS. 1 and 1A.

As described below, following operation of a fuse link within the fuse tube 24, the flipper 74 is able to move the cable 78 downwardly within the fuse tube 24. The release of the tension force applied to the cable 78 by the flipper 74 permits relative movement of the ferrule 72 and the trunnion casting 68 about the toggle joint 70 to permit separation of the contact cap 52 from the spring contact 42.

Figure 2:
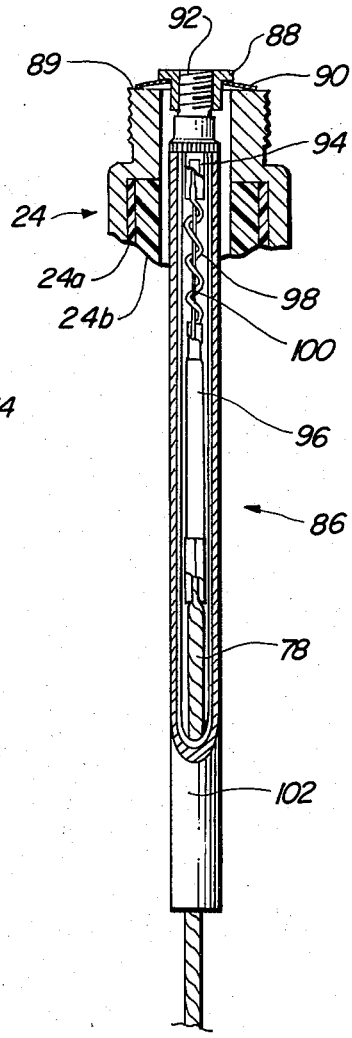
FIG. 2 PRIOR ART
FIG. 2 is an elevational, partially sectioned view of a fuse link according to the prior art which is usable in and with the fuse cutout of FIG. 1, a portion of which is depicted.

Turning now to FIG. 2, there is shown a fuse link 86 as exemplified by the prior art and manufactured in the past by the assignee of the present invention. The fuse link 86 includes a button contact 88 and a washer 90, which have sufficient size to engage a shoulder 89 at the top of the ferrule 50 of the fuse tube 24. The button contact 88 may be threaded onto an upper threaded portion 92 of a second or upper terminal 94 of the fuse link 86. Connected between the second terminal 94 and a first or lower terminal 96 is a fusible element 98 which may be made of pure silver or of a silver-tin alloy, as is well known. The fusible element 98 may be attached to the terminals 94 and 96 by any well known expedient or as described in the above-noted U.S. Pat. No. 4,272,572. Also attached between the terminals 94 and 96 may be a strain wire 100. The function of the strain wire 100 is to resist the pulling force normally exerted on the fuse link 86 by the flipper and spring 74 and 76; most fusible elements 98 do not have sufficient mechanical strength to resist without damage the pulling force applied by the flipper and spring 74 and 76.

In the form of prior art of fuse link 86 depicted in FIG. 2, the first terminal 96 is seen to comprise an elongated sleeve-like member, one end of which is attached or connected to an end of the fusible element 98 and the strain wire 100, if used. The other end of the first terminal 96 is connected to the flexible stranded cable 78 in any convenient fashion, such as by crimping. Surrounding a portion of the second terminal 94, the fusible element 98, the strain wire 100, the first terminal 96, and a portion of the cable 78 is a sheath 102. The sheath 102 may be held in place by attachment or mounting to a lower portion of the second terminal 94, as shown. The sheath 102 is either made of an ablative arc-extinguishing material, such as horn fiber, or may be made of a cellulosic material impregnated with, or otherwise containing, an ablative arc-extinguishing material, such as boric acid or the like. The sheath 102 is shorter than the fuse tube 24, so that an expanse of the arc-extinguishing material 24*b* of the latter is present between the lower end of the sheath 102 and the exhaust opening 80 of the fuse tube 24 (See FIG. 4*b*)

The cutout 10 is armed with the fuse link 86 by first inserting the cable 78 and all of the elements surrounded by the sheath 102 into the fuse tube 24 from the top following removal of the contact cap 52, as described earlier. The button contact 88 and the washer 90 abut the shoulder 89 to limit the amount of downward movement of the fuse link 86 within the fuse tube 24. As described earlier, the cable 78 exists the exhaust opening 80 of the fuse tube 24, following which it is attached to the trunnion casting 68, as described above with reference to FIG. 1*a*. The flipper 74 and spring 76 thus place the entire fuse link 86 under tension; this tension is resisted by the strain wire 100 in such a manner that the fusible element 98 is not damaged. The fuse tube assembly 22 is then inserted into the cutout 10 in the manner depicted in FIG. 1.

If a fault current or other over-current occurs, first the fusible element 98 and then the strain wire 100 fuse, vaporize, or otherwise become disintegral. With the disintegration of the fusible element 98 and of the strain wire 100, the flipper 74 and the spring 76 are free to begin pulling the cable 78 downwardly, separating the terminals 94 and 96. Prior to this time, a high-voltage arc will be established between the terminals 94 and 96. Thus, the action of the flipper 74 and spring 76 in separating the terminals 94 and 96 elongates the arc. At the same time the arc is elongated, in interacts with the sheath 102 causing the evolution therefrom, due to ablation of the arc-extinguishing material, of large quantities of de-ionizing, turbulent and cooling gases. Arc elongation and the action of the evolved gases ultimately may result in extinction of the arc and interruption of current flow in the circuit connected to the connectors 40 and 62 at some subsequent current zero. During the time the gas is evolved from the sheath 102, such gas acts with great force on the first terminal 96 in piston-like fashion. Thus, at some point following the initial movement of the first terminal 96, the force of the evolved gases becomes far greater than the force exerted on the cable 78 by the flipper and spring 74 and 76 and impels the first terminal 96 and a portion of cable 78 connected thereto first out of the sheath 102 and then out of the fuse tube 24. It may be said, then, that the force of the evolved gases violently pushes both the first terminal 96 and the cable 78 out of the sheath 102 and the fuse tube 24. It should be noted that in the prior art fuse link 86 depicted in FIG. 2, the first terminal 96 has some substantial longitudinal dimension. The first terminal 96 is thus able to act as a guide for the cable 78 during its movement through the sheath 102.

If, as noted earlier, the current level of the fault and of the arc is too high, the sheath 102 may burst, or, if it does not, the gases evolved therefrom may be insufficient to extinguish the arc. In either event, the arc will interact with the arc-extinguishing material **24*b* of the fuse tube 24 to evolve gases which together with arc elongation extinguish the arc. To the extent the fuse tube 24** is relied on to extinguish the arc, the invention of the aforementioned application, Ser. No. 132,922 filed Mar. 24, 1980 in the name of William E. Schmunk may be used.

Figures 3, 3A, 3B, 3C, 3D:
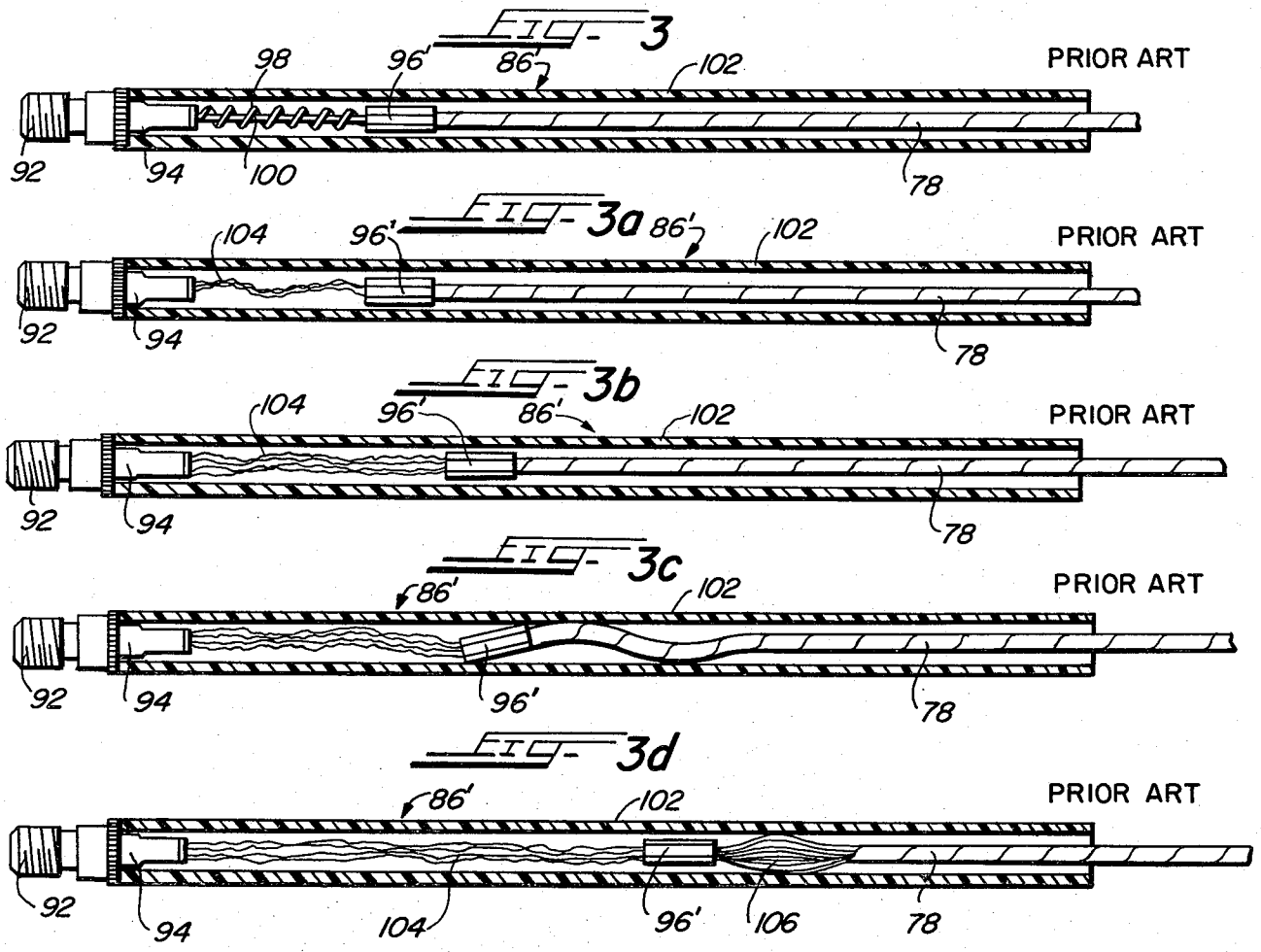
FIG. 3 PRIOR ART
FIG. 3a PRIOR ART
FIG. 3b PRIOR ART
FIG. 3c PRIOR ART
FIG. 3d PRIOR ART
FIG. 3 is an elevational partially sectioned view of another fuse link according to the prior art which is usable with the fuse cutout depicted in FIG. 1.
FIGS. 3*a* through 3*d* are elevational, partially sectioned views similar to FIG. 3, but showing the fuse link thereof at various times during its operation and depicting problems or difficulties with such operation.

FIGS. 3—**3*d* depict another prior art fuse link 86', which is similar to that depicted in FIG. 2, with one difference. In an effort to save material costs, the first terminal 96 in FIG. 2 has been shortened until it takes the configuration 96', depicted in FIGS. 3–3*d*. That being the case, other elements of the fusible element 86' in FIGS. 3–3*d* have the same reference numerals as their corresponding elements in FIG. 2**.

The fuse link 86' depicted in FIGS. 3–**3*d* with the shortened first terminal 96' has been observed to experience certain difficulties in operation. Specifically, and first referring to FIG. 3, the fuse link 86' is shown in its unoperated state. In FIG. 3*a*, the fuse link 86' is shown immediately following melting or vaporization of the fusible element 98 and the strain wire 100 and an arc 104 has been established between the terminals 94 and 96'. In FIG. 3*a*, the first terminal 96' has not begun to move out of the sheath 102 (toward the right in the figure). Such movement of the first terminal 96' has begun in FIG. 3*b*, and, as described earlier, the initial portion of this movement is due to the action of the flipper 74 and the spring 76. Also as described above, at some point during this motion, the high force exerted by the gas evolved from the sheath 102 will overcome the force of the flipper and spring 74 and 76 and will tend to violently push the first terminal 96' out of first the sheath 102, and then the fuse tube 24**.

A first problem detected in the use of the fuse link 86' in FIGS. 3–**3*d* is depicted in FIG. 3*c*. Because the cable 78 is stranded flexible cable and because the major force impelling the first terminal 96' from the sheath 102 is a pushing force, the first terminal 96' may become cocked, as depicted. As the first terminal 96' becomes cocked, its edges engage and bite into the inner walls of the sheath 102, thus either slowing down, inhibiting, or preventing the desirable rapid movement of the shortened first terminal 96' and the cable 78 from first the sheath 102 and the the fuse tube 24. This engagement between the terminal 96' and the walls of the sheath 102 may well adversely affect the proper operation of the fuse cutout 10**.

Another problem encountered by the shortened first terminal 96' is depicted in FIG. **3*d*. Here, because of the high pushing force on the terminal 96' exerted by the evolved gas, the cable 78 has ballooned, as indicated at 106. This ballooning, which may also be referred to as mushrooming, results when the pushing force of the terminal 96' causes the individual strands of the cable 78 to separate, to move apart, and to frictionally engage the walls of the sheath 102. This frictional engagement slows down, inhibits or prevents rapid movement of the terminal 96' and the cable 78 from the sheath 102**.

Notwithstanding the problems with the shortened first terminal 96' depicted in FIGS. 3–**3*d*, some desirable results are achieved with the use of such a terminal 96'. First, the decreased size of the terminal 96' over that of the terminal 96 shown in FIG. 2 reduces material costs. Second, as is well known, during operation of fuse cutouts, such as the fuse cutout 10 shown in FIG. 1, both the first terminal 96 or 96' and the cable 78 may be expelled from the exhaust opening 80 at a very rapid velocity. During this rapid expulsion, it is not unknown for the cable 78 to move in whip-like fashion out of the exhaust opening 80, whipping the terminal 96 or 96' off the end thereof. The whipped-off terminal 96 or 96' becomes a projectile or missile which may, depending on what is located beneath the exhaust opening 80, cause property damage or personal injury. The shortening of the first terminal 96', as illustrated in FIGS. 3—3*d*, decreases the mass of this potential missile or projectile, greatly decreasing the likelihood of serious property damage or personal injury. Again, however, the mere shortening of the terminal 96' creates sufficient operating problems to make the fuse link 86' an unlikely candidate for realistic use in the cutout 10. This is, of course, because the main function of the cutout 10 is to protect the circuit connected to the connectors 40 and 62. If the fuse link 86' does not effect such protection, the entire reason for use of the cutout 10** is defeated.

Referring to commonly assigned U.S. Pat. No. 4,272,751 issued June 9, 1981 the ultimate in mass reduction of the first terminal 96' may be achieved thereby, via total elimination of a sleeve therefrom. Nevertheless, at least the ballooning or mushrooming, if not the cocking, described above, may be exhibited by the improved fuse link of the patent. Thus, the present invention is applicable thereto.

Figure 4:
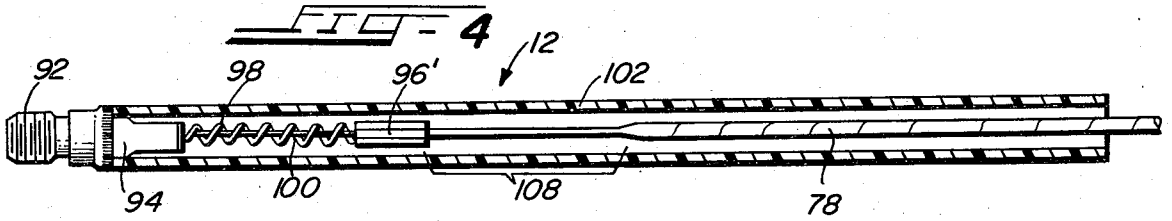
FIG. 4 is an elevational, partially sectioned view of an improved fuse link according to the present invention, which is usable with the fuse cutout depicted in FIG. 1 and which is an improvement upon the fuse links depicted in FIG. 2 through 3*d;*

Referring now to FIGS. 4–**4*b*, there is shown the improved fuse link 12 of the present invention. Most of the elements of the improved fuse link 12 are the same as those depicted with the fuse links 86 and 86' in FIGS. 2 and 3–3*d* and, accordingly, the same reference numerals have been appended thereto. The improved fuse link 12 includes the shortened first terminal 96'. In order to obviate and prevent the problems depicted in FIGS. 3*c* and 3*d* with the fuse link 86', a region 108 of the cable 78 is unified and stiffened immediately adjacent to the first terminal 96' and extending away therefrom a selected distance. The stiffened and unified region 108 acts substantially as a solid rod (along the lines of the terminal 96 depicted in FIG. 2) without the addition of excess and unnecessary material to the terminal 96'. The remainder of the cable 78 remains flexible. In the preferred embodiments depicted in FIGS. 4–4***b*, the region 108 is a compacted region which is produced without the use of heat or of additional material. The region 108 is preferably formed by swaging. It has been found that, when the region 108 is produced by swaging so that it has a cross-sectional area less than that of the remainder of the cable 78 and, more particularly, a cross-sectional area of about 95% of the sum of the cross-sectional areas of the individual strand of the cable 78, good results are achieved. Further, it has also been found that if the region 108 extends away from the terminal 96' for a distance of about one inch, beneficial results are also achieved. Specifically, if formed as described, the region 108 acts as a solid rod serving as both a guide for the first terminal 96' through the sheath 102 to prevent the cocking depicted in FIG. 3*c* and, also, prevents the ballooning or mushrooming 106 depicted in FIG. 3*d* due to what is primarily a pushing force on the terminal 96' by the gases evolved from the sleeve 102. The unified and stiffened region 108, having acted more or less as a solid rod within the fuse tube 24, exhibits another beneficial property. Specifically, and referring to FIG. 4*b*, during the exiting of the terminal 96' and the region 108 from the fuse tube 24, the region 108 may flex when drawn across the edges of the exhaust opening 80 of the fuse tube 24. The region 108 is, accordingly, unlikely to detach itself from the remainder of the cable 78 when it is expelled in whip-like fashion from the exhaust opening 80. Thus, the region 108 permits the use of the small mass, shortened, first terminal 96'. This both decreases material costs of the improved fuse link 12 and permits the use of the shortened terminal 96' to decrease the chances of its effecting property damage or personal injury. Fuse links 12 constructed in the above manner have been shown to perform as well as, or better than, fuse links which as those depicted in FIGS. 2 and 3*a*–3*d*.

Figure 4A:
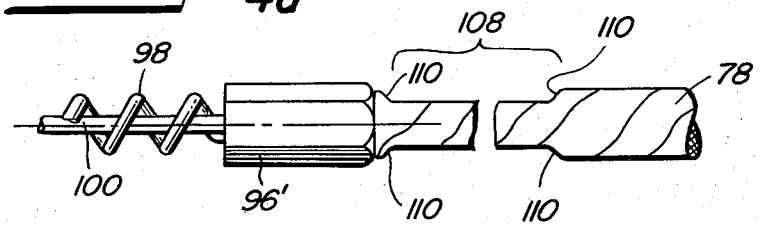
FIG. 4*a* is an enlarged, elevational view of a portion of the fuse link of FIG. 4 depicting in greater detail certain portions thereof.

Referring now to FIG. 4*a*, the region 108 and the first terminal 96' are shown in greater detail. When the region 108 is formed by swaging, it is preferably formed so that it smoothly tapers, as at 110, into the remainder of the cable 78, such that none of the strands of the cable 78 are cut by the swaging. This, of course, decreases the possibility that any portion of the region 108 or of the first terminal 96' will detach themselves from the remainder of the cable 78 upon their rapid expulsion from the exhaust opening 80 of the fuse tube 24.

Figure 4B:
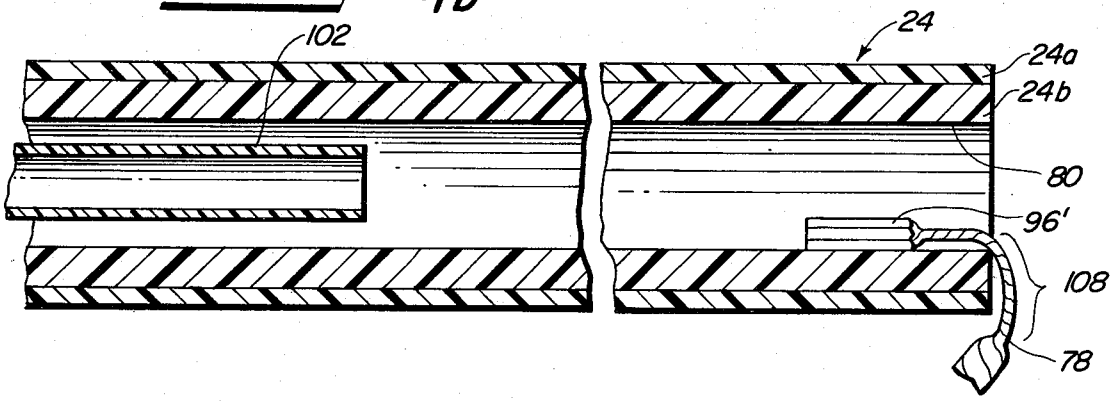
FIG. 4*b* is an enlarged, partially sectioned view of a portion of the fuse link of FIG. 4 and a portion of the cutout of FIG. 1, during the operation thereof.

The region 108 may also be formed with or without the compaction depicted in FIGS. 4–4*b* by the addition to the strands of the cable 78 of an adhesive, polymer, or the like. If sufficient adhesive is added to impregnate the interstices of the strands of the cable 78, the region 108 will act as a solid rod in a functionally similar manner to the swaged region 108 depicted in FIG. 4–4*b*, yet be able to flex as shown in FIG. 4*b*.

As those skilled in the art will appreciate, the extent of the region 108 and the degree of stiffening thereof will depend on, and may be selected with reference to, a number of factors, including:

(a) the spacing between the terminal 96' and the sheath 102;

(b) the length and configuration of the terminal 96';

(c) the flexibility of the cable 78;

(d) the length of the sheath 102, the cable 78, and the fuse tube 24; and (e) the expected range of forces of the gas evolved from the sheath 102 on the terminal 96', in view of the expected range of fault currents in the circuit and the type of arc-extinguishing material of the sheath 102.

The above-described embodiments of the present invention are simply illustrative of the principles thereof. Various other modifications and changes may be devised by those skilled in the art, which embody the principles of this invention, yet, fall within the spirit of the scope thereof.

I claim:

1. An improved fuse link of the type having a fusible element attached between first and second terminals, the first terminal being in turn attached to a length of flexible, stranded cable; the first terminal, the fusible element, at least a portion of the second terminal, and a portion of the cable being normally surrounded by an arc-extinguishing sheath held at one end to the second terminal, wherein the improvement comprises:

a unified and thereby stiffened region of the cable having no sleeve-like or tube-like member thereabout, which region is formed immediately adjacent the first terminal and extends away a selected distance therefrom, the region normally acting substantially as a solid rod, while the remainder of the cable remains flexible.

2. An improved fuse link of the type having a fusible element attached between a length of flexible, stranded cable and a second terminal, the attachment to the cable acting as a first terminal; the first terminal, the fusible element, at least a portion of the second terminal and a portion of the cable being normally surrounded by an arc-extinguishing sheath held at one end to the second terminal; wherein the improvement comprises:

a unified and thereby stiffened region of the cable having no sleeve-like or tube-like member thereabout, which region is formed immediately adjacent the first terminal and extends away a selected distance therefrom, the region normally acting substantially as a solid rod while the remainder of the cable remains flexible.

3. The improved link of claim 1 or 2, wherein:

the region is a compacted region produced without the use of heat or the addition of material.

4. The improved link of claim 1 or 2, wherein:

the region is unified and stiffened by the addition thereto of an adhesive.

5. The improved link of claim 1 or 2, wherein:

the cable includes individual strands, and the region is swaged and has a cross-sectional area less than that of the remainder of the cable.

6. The improved link of claim 5, wherein:

the cross-sectional area of the region is about 95% of the sum of the cross-sectional areas of the individual strands.

7. The improved link of claim 1 or 2, wherein:

the distance is about 1".

8. The improved link of claim 5, wherein:

the region smoothly tapers and merges into the remainder of the cable so that none of the strands are cut by swaging.

9. The improved link of claim 1 or 2 usable in a cutout, during operation of which the fusible element melts and the cable, the first terminal, and the region exit first the sheath and then a fuse tube of the cutout surrounding the sheath, wherein the improvement further comprises:

the region being configured so as to, and its stiffness permitting it to, act as a guide for the first terminal moving through the sheath.

10. The improved link of claim 1 or 2 usable in a cutout, during operation of which the fusible element melts and the cable, the first terminal and the region exit first the sheath and then a fuse tube of the cutout surrounding the sheath, wherein the improvement further comprises:

the region being configured so as to, and its stiffness permitting it to, reduce binding friction between the cable and the sheath in the vicinity of the first terminal.

11. The improved link of claim 1 or 2 usable in a cutout, during operation of which the fusible element melts and the cable, the first terminal and the region exit first the sheath and then a fuse tube of the cutout surrounding the sheath, wherein the improvement further comprises:

the region eliminating bulging or mushrooming of the cable as it moves within the sheath.

12. The improved link of claim 1 or 2 usable in a cutout, during operation of which the fusible element melts and the cable, the first terminal and the region exit first the sheath and then a fuse tube of the cutout surrounding the sheath, wherein the improvement further comprises:

the region remaining stiff within the sheath and the fuse tube, but having the capability of flexing transversely as it exits the fuse tube.

13. The improved link of claim 12, in which as the first terminal and the region exit the fuse tube, the cable moves the whip-like fashion to whip the first terminal and the region; wherein the improvement further comprises:

the first terminal having its length decreased to substantially decrease the mass thereof, the decreased mass of the first terminal and the transverse flexibility of the region as it exits the fuse tube conjoining to substantially reduce the possibility that the first terminal or the region will become detached from the cable, and if detached, to substantially reduce the capability of either to effect property or personal damage.

* * * * *